US009380903B2

(12) United States Patent
Lewis

(10) Patent No.: US 9,380,903 B2
(45) **Date of Patent: *Jul. 5, 2016**

(54) MULTI-PURPOSE HANGER

(71) Applicant: Jeanette Lynn Lewis, Sedalia, CO (US)

(72) Inventor: Jeanette Lynn Lewis, Sedalia, CO (US)

(73) Assignee: HANG A BUNCH, LLC, Bloomfield Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/323,032

(22) Filed: Jul. 3, 2014

(65) Prior Publication Data

US 2014/0312081 A1 Oct. 23, 2014

Related U.S. Application Data

(63) Continuation of application No. 13/417,434, filed on Mar. 12, 2012, now Pat. No. 8,777,069.

(51) Int. Cl.

| | |
|---|---|
| ***A47G 25/28*** | (2006.01) |
| ***A47G 25/14*** | (2006.01) |
| ***A47G 25/74*** | (2006.01) |
| *A47F 7/19* | (2006.01) |

(52) U.S. Cl.

CPC ..... *A47G 25/28* (2013.01); *A47G 25/14* (2013.01); *A47G 25/743* (2013.01); *A47F 7/19* (2013.01)

(58) Field of Classification Search

CPC ..... A47G 25/14; A47G 25/16; A47G 25/24; A47G 25/28; A47G 25/743; A47F 7/19; A47F 7/22; A41D 27/22

USPC ..... 223/85, 88, 92, 95, 97; D6/315, 317, D6/326, 328; 211/113, 119, 123

See application file for complete search history.

(56) References Cited

U.S. PATENT DOCUMENTS

| | | | | | |
|---|---|---|---|---|---|
| 588,711 | A | | 8/1897 | Bachrach | |
| 804,866 | A | * | 11/1905 | Knight | A47G 25/4023 223/94 |
| 976,094 | A | * | 11/1910 | Nichols | A47G 25/4023 223/94 |
| 1,515,600 | A | | 11/1924 | Kornas | |
| D144,679 | S | * | 5/1946 | Bolten | D6/318 |
| D144,871 | S | * | 5/1946 | Read | 223/88 |
| D151,572 | S | | 10/1948 | Tomarin | |
| 2,469,481 | A | | 5/1949 | Snyder | |
| D167,986 | S | | 10/1952 | Jonaitis | |
| 2,630,950 | A | * | 3/1953 | Kupchik | A47G 25/005 223/75 |
| 2,634,031 | A | | 4/1953 | Klein | |
| D190,608 | S | | 6/1961 | Forrester | |
| 3,054,538 | A | * | 9/1962 | Rubin | A47G 25/24 223/88 |
| 3,081,881 | A | | 3/1963 | Seeger | |
| 3,124,253 | A | * | 3/1964 | Petrich | A47G 25/746 211/94.01 |
| 3,346,879 | A | * | 10/1967 | Buzzelli | A47G 25/28 2/271 |
| 3,592,343 | A | | 7/1971 | Swett et al. | |
| 3,783,995 | A | | 1/1974 | Tobin | |
| D243,055 | S | | 1/1977 | Blumberg | |
| D250,242 | S | * | 11/1978 | Knorbel | D6/317 |

(Continued)

*Primary Examiner* — Ismael Izaguirre
(74) *Attorney, Agent, or Firm* — Raggio & Dinnin, P.C.

(57) ABSTRACT

A multi-purpose hanger for use in a closet of a residential or business building. The multi-purpose hanger comprises a body and a hook extending from a top end of the body. The body of the multi-purpose hanger having a plurality of appendages extending therefrom or having a plurality of orifices therethrough wherein the orifices are adjacent to one another in a predetermined pattern. The multi-purpose hanger may allow for clothing or other items to be hung on various columns or rows of hooks or orifices which may be positioned for viewing, display, and/or easy storage of the items thereon.

18 Claims, 3 Drawing Sheets

(56) References Cited

U.S. PATENT DOCUMENTS

| | | | | | |
|---|---|---|---|---|---|
| 4,136,784 | A | | 1/1979 | Knobel et al. | |
| D267,919 | S | * | 2/1983 | Owens | D6/315 |
| D281,931 | S | * | 12/1985 | Arnold | D6/317 |
| 4,709,838 | A | | 12/1987 | Campbell | |
| D342,834 | S | | 1/1994 | Lorenzana | |
| D353,943 | S | | 1/1995 | Varin | |
| D372,592 | S | * | 8/1996 | Tran | D6/317 |
| D404,578 | S | * | 1/1999 | Prince | D6/315 |
| 5,934,524 | A | | 8/1999 | Gray | |
| 6,398,086 | B1 | | 6/2002 | Bennett | |
| 8,146,784 | B1 | * | 4/2012 | Calanca et al. | 223/94 |
| D668,880 | S | | 10/2012 | Lewis | |
| D704,458 | S | * | 5/2014 | Berger | D6/315 |
| 8,720,842 | B2 | * | 5/2014 | Huang et al. | 248/339 |
| 8,777,069 | B2 | | 7/2014 | Lewis | |
| D711,123 | S | * | 8/2014 | Birge | D6/317 |
| D716,562 | S | * | 11/2014 | Goodman et al. | D6/317 |
| D722,438 | S | * | 2/2015 | Tsai | D6/315 |
| D722,439 | S | * | 2/2015 | Goodman | D6/317 |
| 2002/0108976 | A1 | | 8/2002 | Carmichael | |
| 2005/0023310 | A1 | | 2/2005 | Noda | |
| 2006/0213937 | A1 | | 9/2006 | Fife | |
| 2006/0226179 | A1 | | 10/2006 | Hsu | |
| 2007/0029355 | A1 | | 2/2007 | Dente, Jr. | |
| 2010/0051655 | A1 | | 3/2010 | Gouldson | |
| 2012/0074181 | A1 | | 3/2012 | Reid | |

* cited by examiner

MULTI-PURPOSE HANGER

This application is a continuation of pending U.S. application Ser. No. 13/417,434—Filed Mar. 12, 2012

BACKGROUND OF THE INVENTION

1. Field of the Invention

This invention generally relates to hangers, and more particularly, relates to a multi-purpose hanger for clothing or other items which may be hung on various columns and rows of hooks or orifices, which may be positioned for viewing, displaying or storage.

2. Description of Related Art

Hangers have been known for many years in the prior art. Many prior art hangers have the traditional triangular shape with a hook extending from a top end thereof. These prior art hangers are generally made of metal, wood or plastic material, etc. Many of these prior art hangers also include components that allow for pants to be hung from the bottom slat of the hanger. This allows for a suit coat and pants to be hung on one hanger. However, many of these prior art hangers are not capable of being used to hang or store scarves ties, or other fashion accessories to create clear viewing display and storage for such fashion accessories in a closet.

Therefore, there is a need in the art for an improved multi-purpose hanger. There also is a need in the art for a multi-purpose hanger for clothing or other items, which may be hung on various columns and rows of hooks, which may be positioned for viewing, display and/or storage of fashion accessories, such as scarves, ties, socks, etc. There also is a need in the art for a multi-purpose hanger that allows various items to be displayed in a combination of different hooks and shapes which may be staggered, layered, or interwoven to allow for easy storage, viewing and usage of the clothing, fashion accessories and other items. There is also a need in the art for a multi-purpose hanger that has excellent access, minimum storage and space requirements to allow for multiple pieces of clothing, fashion accessories and/or other items to hang within a closet. There also is a need in the art for a multi-purpose hanger that has an outer finish that will not damage or harm by either catching, snagging, or otherwise interacting with the items arranged thereon. There also is a need in the art for a multi-purpose hanger that provides an aesthetically and pleasing and non-staining smooth finish that allows for easy insertion and removal of items thereon without disturbing adjacent items thereto.

SUMMARY OF THE INVENTION

One object of the present invention may be to provide an improved hanger.

Another object of the present invention may be to provide an improved multi-purpose hanger.

Still another object of the present invention may be to provide a multi-purpose hanger for clothing or other items which may be hung on various columns and rows of hooks, which may be positioned for viewing, display and/or storage.

Still another object of the present invention may be to provide a multi-purpose hanger that is generally made of any type of material, which is capable of having an outer finish that produces an aesthetically pleasing, non-staining and smooth hanger.

Still another object of the present invention may be to provide a multi-purpose hanger that allows for easy insertion and removal of items into and from the hanger without disturbing adjacent items.

Yet another object of the present invention may be to provide a multi-purpose hanger having a finish that will not damage or harm via catching, snagging, or otherwise interacting with the items arranged thereon.

Still another object of the present invention may be to provide a multi-purpose hanger that includes a hanging hook arranged at an upper portion of a body of the hanger and a plurality of rows and columns of various appendages.

To achieve the foregoing objects and other advantages, a multi-purpose hanger is disclosed. The multi-purpose hanger comprises a body and a hanging hook extending from a top end of the body. The multi-purpose hanger also comprises the body having a plurality of appendages extending therefrom or a plurality of orifices arranged therethrough wherein the orifices are adjacent to one another in a predetermined pattern.

One advantage of the present invention may be that it provides a novel and improved hanger.

Still another advantage of the present invention may be that it provides a novel and improved multi-purpose hanger.

Still another advantage of the present invention may be that it provides a multi-purpose hanger for clothing or other items, which may be hung on various columns and rows of hooks and/or orifices which may be positioned for viewing, display and/or storage in a variety of layouts and patterns.

Yet another advantage of the present invention may be that it provides a multi-purpose hanger that is made of any known material that is capable of having an outer finish that produces an aesthetically pleasing, non-staining and smooth hanger.

Still another advantage of the present invention may be that it provides a multi-purpose hanger that allows for easy insertion and removal of items or clothing from the hanger without disturbing adjacent items.

Still another advantage of the present invention may be that it provides for a multi-purpose hanger that has an outer surface finish that may not damage or harm via catching, snagging, or otherwise interacting with the items arranged thereon.

Yet another advantage of the present invention may be that it provides for a multi-purpose hanger that has a hanging hook or element arranged at an upper portion of the body of the hanger and a plurality of rows and columns of various hooks, orifices or other components extending from a bottom portion of the hanger body.

Other objects, features and advantages of the present invention may become apparent from the subsequent description and appended claims, taken in conjunction with the accompanying drawings.

DESCRIPTION OF THE EMBODIMENT(S)

Figure 2:
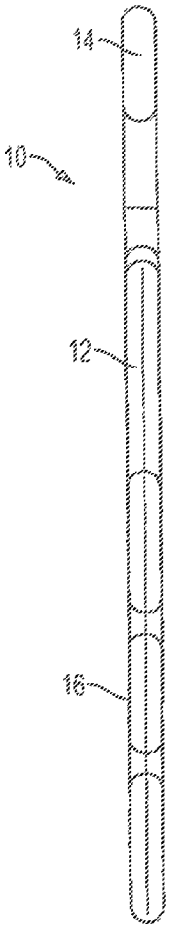
FIG. 2 is an end view of the multi-purpose hanger of FIG. 1.
Figure 1:
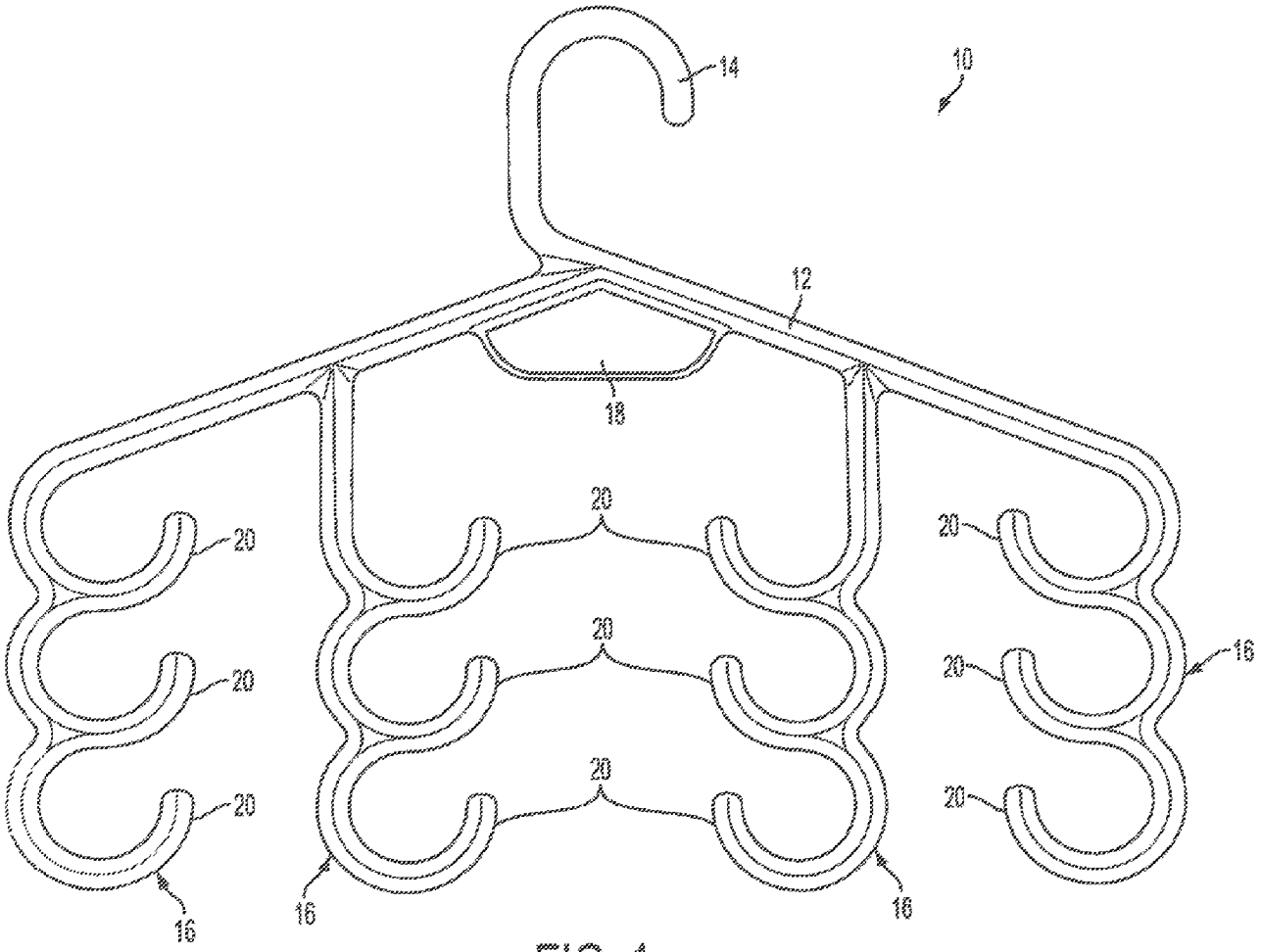
FIG. 1 is a perspective view of a mufti-purpose hanger according to the present invention.
Figure 4:
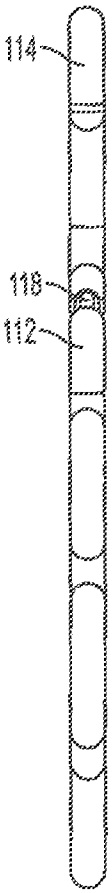
FIG. 4 is an end view of the multi-purpose hanger of FIG. 3.
Figure 3:
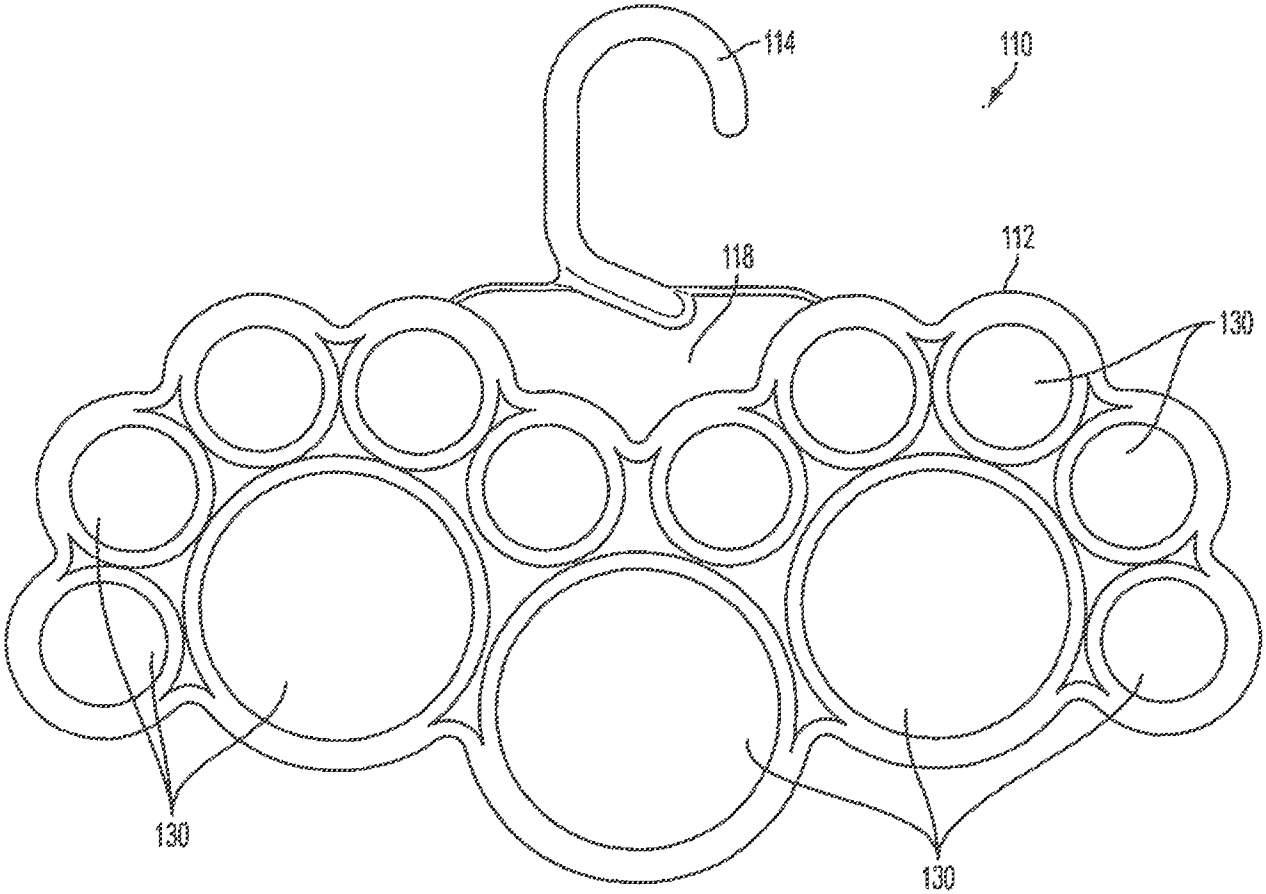
FIG. 3 is a perspective view of an alternate embodiment of a multi-purpose hanger according to the present invention.
Figure 6:
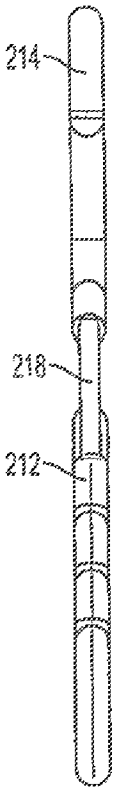
FIG. 6 is an end view of a multi-purpose hanger of FIG. 5.
Figure 5:
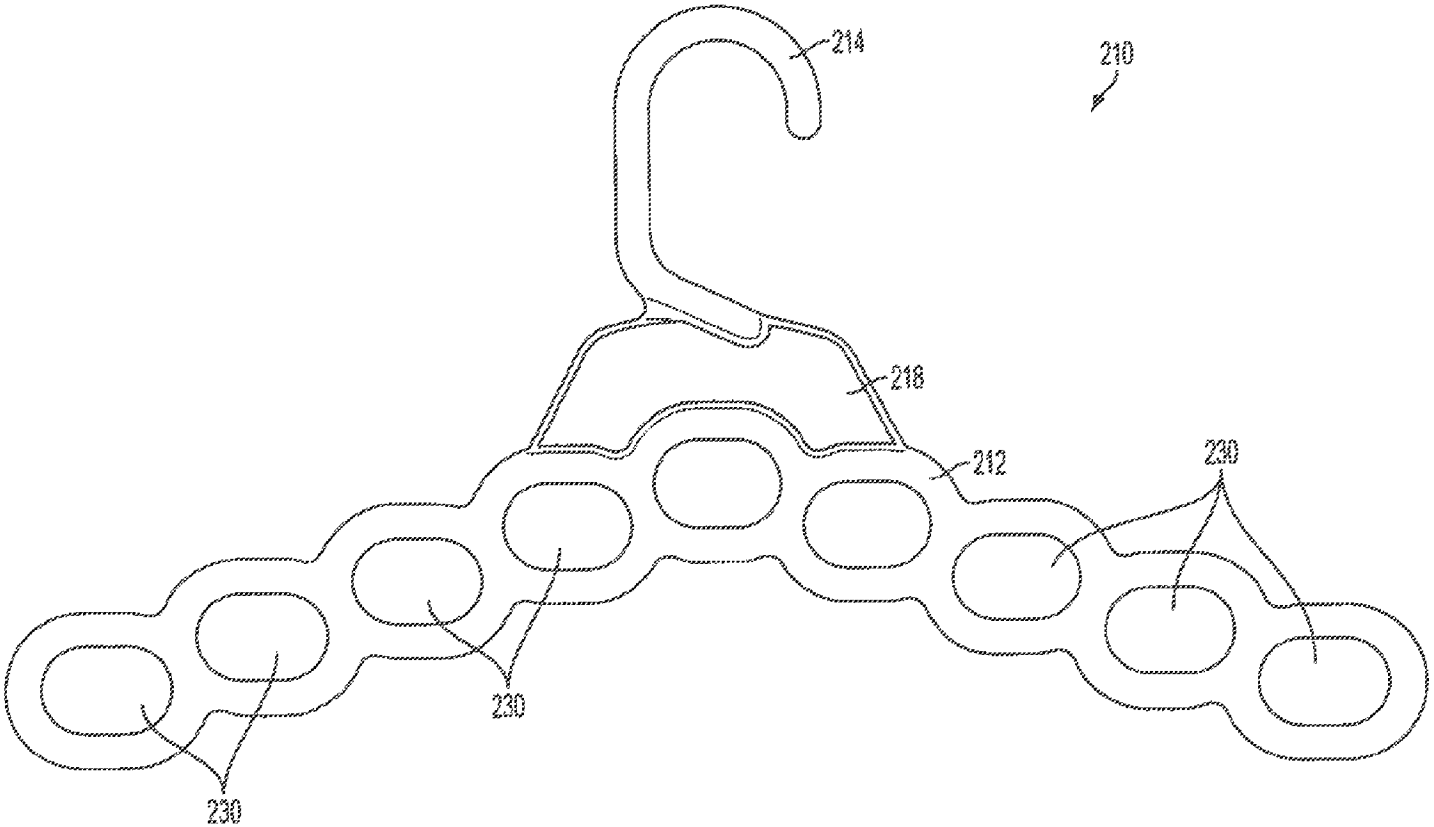
FIG. 5 is a perspective view of an alternate embodiment of a multi-purpose hanger according to the present invention.

Referring to the drawings, a multi-purpose hanger 10 is disclosed. The multi-purpose hanger 10 is for clothing or other items, which may be hung on various columns or rows of hooks, orifices or other components which may be positioned for viewing, display and storage of the clothing or items. It should be noted that various items may be displayed on the combination of different hooks and shapes and/or orifices and may be staggered, layered, or interwoven to allow for easy storage, viewing and usage of the multi-purpose hanger 10 and the items arranged thereon. The multi-purpose hanger 10 affords excellent access, while requiring minimum storage and space for the amount of items stored thereon. The multi-purpose hanger 10 may consist of multiple columns and rows of fingers, components or orifices having various shapes including but not limited to half circles, circles, squares, triangles, rectangles, spheres, trapezoids, and/or any other known shape. It should be noted that the overall size and number of columns and rows may be changed to accommodate various numbers of clothing, other items and/or fashion accessories stored thereon.

The multi-purpose hanger 10 as shown in the drawings generally includes a body 12 having a predetermined shape. Attached and extending from one end of the body 12, in particular the top end of the body 12, is a hanging hook or element 14 which is used to secure the hanger 10 to a rod that is either arranged in a closet or other room in a residential or commercial building. The hanging hook 14 allows for removal of the hanger 10 from the rod to assist in either loading or unloading clothing or other items from the multi-purpose hanger 10. It should be noted that the hanger body 12 and hook 14 generally is manufactured out of any known material including but not limited to high density polyethylene, and/or any other type of metal, plastic, polymer, clay, resin, cloth, wood, or any other natural material known. Generally, any type of material may be used to produce the multi-purpose hanger 10 of the present invention as long as that material is capable of being finished to produce an aesthetically pleasing and non-staining smooth finish on its outer surface. The multi purpose hanger 10 may be manufactured by any known methodology such as but not limited to molding, forming, machining, etc. In one embodiment of the present invention the body 12 of the multi-purpose hanger 10 may generally have a plurality of appendages 16 extending from an upper spar or bar member. Generally, the upper spar or bar member has a predetermined curve or angle when viewed from the side. The plurality of appendages 16 extend from the body 12 in a vertical downward direction from the body 12. In one contemplated embodiment these appendages 16 are equi-distantly spaced and extend from a bottom surface of the body 12. However, it is also contemplated to have the appendages 16 arranged non equi-distantly at various points along the body 12. The hanger body 12 may also include a reinforcing plate 18 that is arranged directly adjacent to or below the intersection of the hanging hook 14 and the body 12 thus increasing the strength of the hanger 10 to allow for multi pieces of clothing and/or other items to be hung therefrom.

It should further be noted that the hanging hook 14 may face in either direction with relation to the body 12. The appendages 16 generally extend down in a generally vertical direction from the bottom surface of the body 12 a predetermined distance. It should be noted that any known length or distance may be used for the appendages 16 extending from the body 12. In one contemplated embodiment the appendages 16 are formed by a plurality of fingers 20 interwoven or clustered with one another. The plurality of fingers 20 generally resemble a generally half circle shape. The half circle shapes are clustered and/or interconnected with each other to form an entire appendage 16. Generally, the fingers 20 create a set of mini hooks, which allow for a clothing or item to be hung on each finger 20 of the body 12. Each of the fingers 12 generally have the semi half circle opening facing inwards or towards a center of the hanger 10. It is also contemplated to have the fingers 20 reversed and face the outer direction of the body 12 of the hanger 10. It should be noted that the fingers 20 of the appendages 16 may also be formed in any other known shape other than that of a generally half circle. Any known shape, such as square, triangular, rectangular, spherical, trapezoidal, or any other known shape, including orifices, may also be used and aligned in the column and row manner of the appendages 16 and fingers 20 of the present invention. As shown, the plurality of fingers 20 that form the plurality of appendages 16 that extend from the body 12 of the multi-purpose hanger 10 form a plurality of rows across in a generally horizontal direction with regard to the hanger 10 while the appendages 16 form the vertical or columns for the multi-purpose hanger 10. Thus, it should be noted that any number of columns and/or rows may be used to form the multi-purpose hanger 10 according to the present invention. In one contemplated embodiment four appendages may be equi-distantly spaced and extend from a bottom portion of the body 12 of the multi-purpose hanger 10, wherein at least two of the four appendages extend from the very end of the body 12 of the hanger 10. Each of the appendages 16 in one contemplated embodiment may then have three fingers 20 arranged thereon equi-distantly along the length of the appendage 16. It should be noted that any number of fingers 20 and/or appendages 16 may be used depending on the size and the environment in which the hanger 10 may be used. Furthermore, the use of the hooks 20 and the configuration as described above may allow for easy insertion and removal of clothing and items onto the multi-purpose hanger 10 without disturbing adjacent items arranged thereon. Furthermore, the multi-purpose hanger 10 also has an outer surface finish that is smooth which may ensure that no damage or harm occurs to the clothing or other objects via catching, snagging, or otherwise interacting with the items being stored on the multi-purpose hanger 10.

Another embodiment of the multipurpose hanger 10 according to the present invention is also shown in the drawings. Like numerals indicate like parts. The multi purpose hanger 110 generally includes a body 110 and a hanging hook 114 extending from a top end of the body 112 as described above. The body 112 also may include a reinforcement plate 118 that is arranged directly adjacent to the hanging hook 114. The body 112 may also include a plurality of orifices 130 therethrough wherein the orifices 130 are adjacent to one another in a predetermined pattern. In one embodiment as shown in the figures, the body 112 may have a plurality of orifices 130 that have a predetermined shape. In one contemplated embodiment this shape is a circular shaped orifice, however, it should be noted that any other shaped orifice, such as but not limited to half circles, squares, triangles, rectangles, spheres, trapezoids, or any other known shape or random shape may also be used for the orifices 130. The plurality of orifices 130 of the multi-purpose hanger 110 may have a first size set of orifices and a second size set of orifices arranged in predetermined patterns throughout the body 112. In one contemplated embodiment the first size set of orifices 130 may be smaller than the second size set of orifices 130 by any known dimension. In one contemplated embodiment the diameter of the first size set of orifices 130 may generally be one half the size of the diameter of the second size set of orifices 130. The first size set of orifices 130 are generally arranged along an outer top edge of the body 112. In one contemplated embodiment this outer top edge generally may form an "M" shape when viewed from the side. The second size set or larger orifices 130 of this embodiment may be arranged at or near an outer bottom edge of the body 112 in any known pattern, but generally adjacent to one another and generally adjacent to the smaller orifices of the first size set. In one contemplated embodiment a total of ten smaller sized orifices 130 may be arranged along the top edge of the body 112 and three second set or larger sized orifices 130 may generally be arranged near the bottom edge of the multi-purpose hanger 110. This may allow for the hanging and storage of different sized items, such as clothing, or other items used in fashion or other items needed to be stored every day. It should be noted that the combination of smaller shaped orifices and larger shaped orifices may be arranged in other shapes than as that specifically described and that any known shape and pattern for the small shaped orifices or the large shaped orifices interspersed with each other may be used with the present invention.

Yet another embodiment of the present invention is also disclosed in the drawings. Like numerals indicate like parts. The hanger body 212 of this embodiment generally has a hanging hook 214 extending from a top end of the body 212 of the multi-purpose hanger 210. The multi-purpose hanger body 212 also includes a reinforcement plate 218 arranged directly below or adjacent to the hanging hook 214 to increase the stiffness and strength of the multi-purpose hanger 210. This embodiment of the multi-purpose hanger 210 generally includes a plurality of orifices 230 arranged in a generally linear alignment having a predetermined shaped curve along an entire length thereof. This plurality of orifices 230 is generally arranged like a chain with a predetermined curve, such as that of prior art hangers. These orifices 230 may be of any diameter and allow for the hanging of scarves, ties, socks or any other known clothing or any other type of item to be displayed and stored in a way that provides for excellent access and minimum storage and requirement spaces in a closet of a home or business. It should be noted that it is also contemplated in this embodiment to use shapes other than the circular orifices 230 as shown in the drawings, such as triangular, squares, spherical, trapezoidal, or any other known shape or random shape. It is also contemplated to create a full enclosed circle or other shape of interlinked orifices 230 as shown in this embodiment to form a plurality of hanging options for clothing or other items for the multi-purpose hanger 210. It is also contemplated to have a plurality of orifices 230 connected to another plurality of orifices 230 by an arm extending between the main body 212 of the multi-purpose hanger 210 and a separate second body with the same plurality of orifices arranged in any known pattern.

The present invention has been described in an illustrative manner. It is to be understood that the terminology which has been used, is intended to be in the nature of words of description rather than that of limitation.

Many modifications and variations of the present invention are possible in light of the above teachings. Therefore, within the scope of the appended claims, the present invention may be practiced otherwise than as specifically described.

What is claimed is:

1. A multi-purpose hanger, said hanger comprising:

a body;

a hook extending from a top end of said body, one half of said body extends in a first direction from said hook and another half of said body extends in a second direction from said hook; and said body having a plurality of appendages extending from said one half of said body and from said another half of said body in a vertical direction therefrom, said appendages having a plurality of fingers, said plurality of fingers are arranged in said vertical direction, said finger having a generally half circle shape, said half circle having an opening facing inwards toward a center line of the hanger.

2. The hanger of claim 1 wherein said appendages form at least four columns extending in a downward direction from said body.

3. The hanger of claim 1 wherein said fingers having an opening facing a predetermined direction of said body.

4. The hanger of claim 3 wherein said fingers having a predetermined shape.

5. The hanger of claim 1 wherein said plurality of fingers align to form rows for the hanger.

6. The hanger of claim 1 wherein said body having four appendages.

7. The hanger of claim 1 wherein said appendages having three fingers.

8. The hanger of claim 1 wherein the hanger is made of a plastic having a smooth outer surface or a smooth non-staining outer surface.

9. The hanger of claim 1 wherein said fingers form mini hooks for holding clothing or other fashion accessories.

10. A multi-purpose hanger, said hanger comprising:

a body;

a hook extending from a top of said body; and said body having a plurality of generally circular orifices therethrough, said orifices adjacent to one another in a predetermined pattern, a first sized set of said generally circular orifices form and define a top edge of said body, said first sized orifices are arranged to form a continuous chain like pattern, said first sized set of orifices are smaller in said diameter than a second sized set of orifices.

11. The hanger of claim 10 wherein said plurality of orifices having a predetermined diameter.

12. The hanger of claim 11 wherein said plurality of orifices arranged in a generally linear alignment having a predetermined shaped curve along an entire length thereof.

13. The hanger of claim 10 further comprising a reinforcing plate arranged between said hook and said body.

14. The hanger of claim 13 wherein an outer edge of each of said first sized orifices contacts at least one other outer edge of another said first sized orifice.

15. The hanger of claim 14 wherein said first sized set of orifices having a predetermined shape when viewed from a side.

16. The hanger of claim 10 wherein said second sized set of orifices form and defines an outer bottom edge of said body.

17. The hanger of claim 10 wherein said first sized set of orifices are generally one half the size of said second sized set of orifices.

18. A multi-purpose hanger, said hanger comprising:

a body;

a non-slidable hook extending from a top of said body;

a reinforcing member; and said body having a plurality of appendages extending therefrom, said appendages having a plurality of fingers, said fingers having a generally half circle shape, said half circle having an opening facing inwards toward a center line of the hanger.

* * * * *